US005454702A

United States Patent [19]

Weidhass

[11] Patent Number: 5,454,702

[45] Date of Patent: Oct. 3, 1995

[54] INVALUTE GEARSET

[75] Inventor: Horst Weidhass, Hof, Germany

[73] Assignee: John S. Barnes GmbH, Hof, Germany

[21] Appl. No.: 244,216

[22] PCT Filed: Nov. 12, 1992

[86] PCT No.: PCT/EP92/02592

§ 371 Date: May 20, 1994

§ 102(e) Date: May 20, 1994

[87] PCT Pub. No.: WO93/11357

PCT Pub. Date: Jun. 10, 1993

[30] Foreign Application Priority Data

Nov. 27, 1991 [DE] Germany ..... 41 38 913.1

[51] Int. Cl.[6] ..... F01C 1/18; F16H 55/08

[52] U.S. Cl. ..... 418/206; 418/171; 74/462

[58] Field of Search ..... 418/206, 171, 418/150, 170; 74/462

[56] References Cited

U.S. PATENT DOCUMENTS

| | | | |
|---|---|---|---|
| 2,447,104 | 8/1948 | Trbojevich | 74/462 |
| 3,640,650 | 2/1972 | Wydler | 418/206 |
| 3,855,874 | 12/1974 | Homma et al. | 74/462 |
| 5,135,373 | 8/1992 | Cozeus | 418/206 |

FOREIGN PATENT DOCUMENTS

| | | | |
|---|---|---|---|
| 1442778 | 7/1976 | United Kingdom | 418/206 |

*Primary Examiner*—Timothy S. Thorpe
*Assistant Examiner*—Charles G. Freay
*Attorney, Agent, or Firm*—Anderson Kill Olick & Oshinsky

[57] ABSTRACT

An involute gearset formed of at least two meshing gear wheels the teeth of which have flanks formed of different curves including an involute in the central region, an arcuate region adjoining the involute, and a straight line segment which intersects the end face of a respective tooth and tangentially passes into the arcuate region.

14 Claims, 4 Drawing Sheets

INVALUTE GEARSET

BACKGROUND OF THE INVENTION

The present invention relates to an involute gearset, which formed by meshing gear teeth of at least two gear wheels of a gear mechanism, with each gear tooth having a tooth profile formed of different profile shapes.

The concept gearwheel mechanism covers gear pumps as well as gear type motors, which includes at least a pair of gear wheels in engagement with one another. Both meshing gear wheels can have an external set of teeth as well as an internal set of teeth. In the last-named embodiment a spur gear wheel provided with external teeth and designated as external wheel meshes with a gear wheel carrying internal gearing designated as a ring gear.

In gearwheel mechanisms of the type under discussion here it has often proved to be disadvantageous, that considerable noise arises in operation, which among other reasons is caused by a so-called entry shock. Such shocks arise always if a new tooth of a gear wheel enters into engagement with the tooth flank of the associated second gear wheel. An entry shock is for instance caused by pitch deviation, which is based either on fabrication processes or on a deformation of the teeth meshing with each other. Thus deformations based upon flexing of the teeth under load are practically unavoidable in the operation of a gearwheel mechanism. Also in those cases when fabrication errors are reduced to a minimum, engagement interference caused by deformations under load can occur in the course of lagging of the driven gear wheel, with the engagement interference resulting in an engagement shock.

It is therefore the task of the invention to provide a gear of a gearwheel mechanism or geared machine of the above-mentioned type, where the noise generation is considerably reduced.

The task of the invention is achieved by providing an involute gearset, in which the tooth flanks of the individual teeth of the gear wheels comprise an involute in the flank central region adjoined by an arcuate region which passes tangentially into a straight line segment intersecting the tooth end face, so that a straight line of action is formed at the pitch point in the involute region.

Proceeding from the conventional involute gearing, it is contemplated a form the tooth profiles or flanks of the wheels meshing with one another of differently curved segments and thereby create a so-called cycloid gearing. The conventional involute is provided in the central region of the tooth profile or flank which continues in an arcuate region towards the tip area of the tooth with the arcuate segment transiting tangentially into an adjacent straight line segment. This straight line segment cuts then directly through the tip surface of the tooth. In this way a straight line of action is assured at the pitch or rolling point in the region of the involute. Engagement shocks can be avoided due to the design of the tooth flanks of the teeth in operation of the gearwheel mechanism, also in case of fabrication flaws or by deformation under load of the individual teeth meshing with each other. This results in an operation of the mechanism generating very little noise.

An embodiment form of the gearwheel mechanism is especially preferred where the arcuate region is shaped as a circular arc, whose radius of curvature coincides with the radius of curvature of the involute region directed adjacent to the arcuate region, wherein preferably the involute and the arcuate region transit tangentially into one another. Due to this design there results a very uniform force transmission from a gear wheel connected to the drive to the driven gear wheel. The vibration excitation of the gear wheels meshing with each other is thus reduced to a minimum.

An embodiment of the gearwheel mechanism is especially preferred where the distances of the transition between the straight line region and the arcuate region or the arcuate region and the involute measured from the end face of the gear tip are in an approximate ratio of 1:2 to one another. Due to this design a particularly uniform force transmission occurs in the vicinity of the tip of a tooth. This design insures that vibration excitations, which could result in noises inside the gearwheel mechanism, are at a minimum.

Furthermore an embodiment form of the gearwheel mechanism is particularly preferred, where the tooth profile or flank in the region of the tooth root is configured in the shape of a cycloid-like curve, especially a cycloid in order to avoid an undercut, which cycloid is directly adjacent to the involute provided in the central region of the tooth flank or profile. This results in an extension of the active tooth flank or profile which leads to a particularly uniform force transmission between the two associated gear wheels, which again assists in avoiding vibration excitations.

BRIEF DESCRIPTION OF THE DRAWINGS

In the following the invention is described with particularity with the help of the drawing. It is shown in.

DETAILED DESCRIPTION OF THE PREFERRED EMBODIMENT

Figure 1:
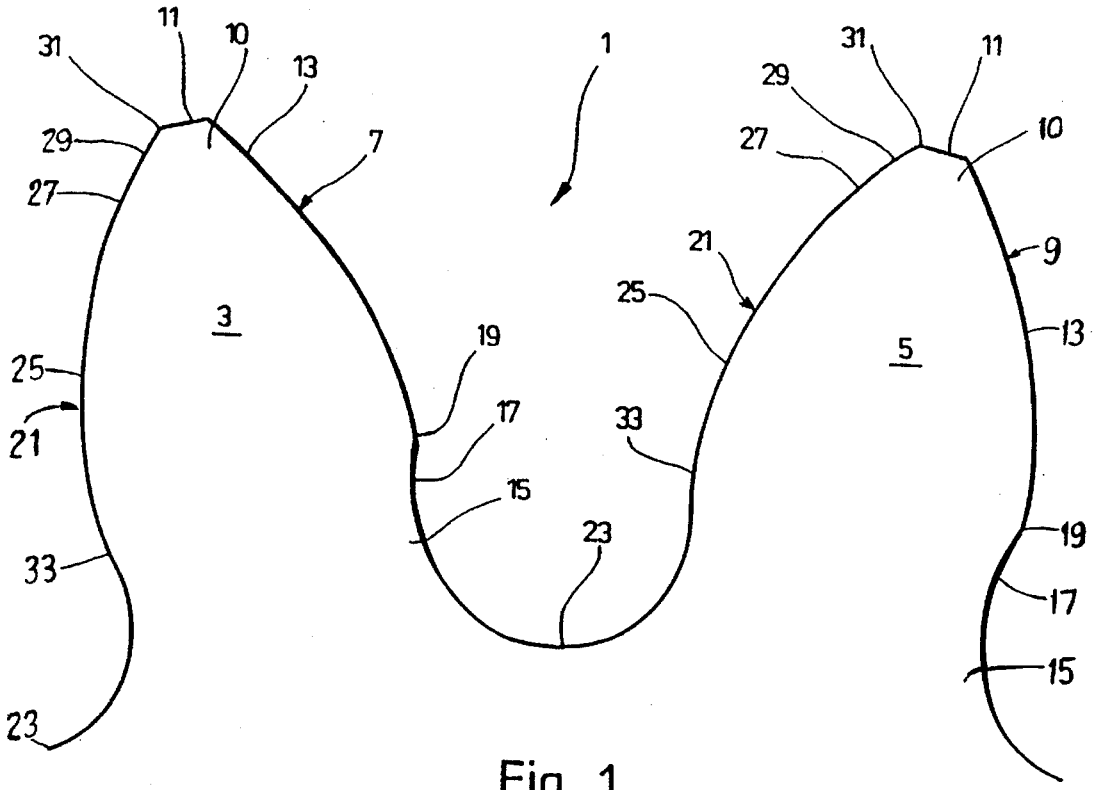
FIG. 1 a cutout of a side view of a gear wheel provided with an external set of teeth.

In the illustration of the cutout of a gear wheel 1 in FIG. 1 the right hand flanks respectively of the shown teeth 3 and 5 are designed in the known manner, while the left hand flank of the teeth 3 and 5 has the configuration according to the invention.

The right hand tooth flanks 7 and 9 have an involute 13 proceeding from the end face 11 of the tooth tip 10, which extends from the tooth tip across the central region of the tooth flank up to the root region 15. A conventional undercut 17 is provided in the root region itself, wherein an edge 19 configured in the transitional region between the involute 13 and the undercut 17 is clearly visible. The undercut serves for preventing an entry shock upon entry of a new tooth of the additional gear wheel assigned to the gear wheel 1.

The illustration in FIG. 1 shows that the left tooth flanks 21 have a different course compared to the known flanks 7 and 9. Proceeding from the end face 11 of the tooth tip 10 up to the transition region 23 of two adjacent teeth there results a continuous flank without any steps or kinks of any kind. An involute 25 is again provided in the central region of the tooth flank, which is followed by an arcuate region 27 in the upper segment facing the tooth tip 10, which region 27 on its part continues into a straight line segment 29. The straight line segment 29 continues directly up to the end face 11 of the gear wheels 3 and 5, so that an edge 31 is formed solely here, thus externally of the active tooth flank, which edge 31 forms a negative cutting edge.

The transition of the involute 25 in the root region 15 of the tooth 3 or 5 is continuous. A cycloid 33 follows upon the involute 25, which results in a lengthening of the active tooth flank. An undercut 17, such as it can be seen in the state of the art in the region of the right hand tooth flank 7 or 9, is avoided in this case.

A cycloid-like curve is designated in this connection by the expression cycloid, which thus deviates from a trochoid and is preferably designed as a cycloid for achieving a particularly smooth transition.

After all this there thus results a continuous tooth flank progression from the tooth tip 10 to the tooth root 12, in particular since the lower regions of the tooth tip or the tooth root adjacent to the involute 25 transit tangentially into the involute.

Figure 2:
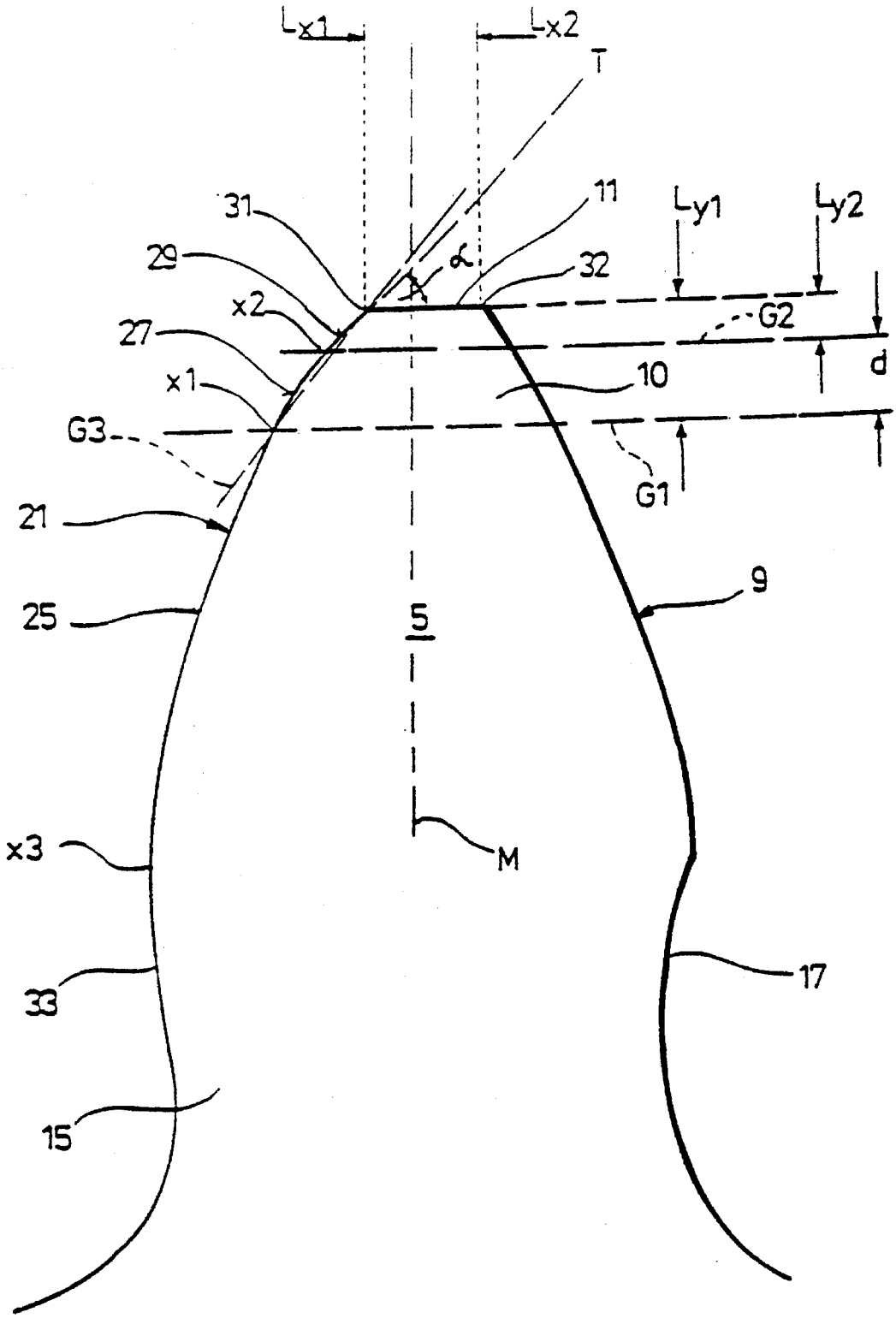
FIG. 2 a single magnified tooth of the gear wheel shown in FIG. 1.

The course of the left flank 21 can be seen even more clearly on the magnified illustration of a single tooth for instance the tooth 5 shown in FIG. 2. The transition between the central region configured as an involute 25 and the circular arc 27 is designated by x1. The transition point between the arcuate region 27 and the straight line segment 29 is indicated in FIG. 2 by x2. The transition between the involute and the adjacent cycloid 33 is designated by x3.

Several substitute lines are shown additionally as dashed lines in FIG. 2, which will be explained in detail in the following manner. An imaginary first straight line G1 is drawn parallel to the end face 11 of the tooth tip 10 which imagined line intersects the tooth flank at the point x1. A second imaginary line G2 runs parallel to the end face 11, while intersecting the tooth flank at the point x2. The distance between the end face 11 and the line G1 is designated by $L_{y1}$, the distance between the end face 11 and the line G2 is designated by $L_{y2}$.

The edge 31 which is formed by the intersection of the straight line segment 29 with the end face 11 of the tooth tip 10, is connected by an imaginary line G3 with the point x1. In addition, a tangent T is shown at the straight line segments 29 in the region of the edge 31 which intersects the end face 11 at an angle a.

The curvature of the arcuate region 27 is made to be clearly recognizable by the subsidiary line G3. The said arcuate region is preferably configured as a circular arc, wherein the radius of curvature of the circular arc is chosen to be as large as the radius of curvature of the involute 25 before said involute reaches the transition x1. In addition the flank segments 25 and 27 are designed to transit tangentially into one another, so that a particularly smooth transition between the different tooth flank regions is achieved at the point x1.

The curved arc 27 transits just as smoothly into the straight line segment 29, since the two flank segments run tangentially to one another at the point x2.

The angle a of the tangent T at the straight line segment 29 in the region of the edge 31 is selected to be as large as possible. It lies in the range of approximately 45° and can vary by approximately 5° to 10°.

The spacings $L_{y1}$ and $L_{y2}$ are matched to each other in order to assure an optimum force transmittal in the region of the tooth tip 10 upon contact of the associated tooth flank 21 with the corresponding tooth of another gear wheel. Proceeding from the equation $L_{y1}$0.4 x module, the spacing $L_{y1}$ is preferably selected to be twice as large as the spacing $L_{y2}$.

In the embodiment example shown here there results a relationship of almost 3:1. If one considers the spacing d of the straight line G1 and G2 from one another, there results the following spacing relationship:

$L_{y2}$: d is approximately 40:60 up to 60:40, preferably 55:45 to 45:55 and especially 50:50 .

The tooth center M is shown in FIG. 2 by a dashed line. The spacing of the edge 31 to the tooth center is designated by $L_{x1}$, the spacing of the corresponding edge 32 of the right hand tooth flank 9 is designated by $L_{x2}$. It is easily seen from the sketch in FIG. 2, that the spacing $L_{x1}$ is smaller than the spacing $L_{x2}$, that thus the tooth edge 31 is offset backwards compared to the edge 32 known in the state of the art. Entry shocks are prevented in this way in operation of the gearwheel mechanism by using the tooth flank 25 described here.

On the other hand due to the set back edge 31 the undercut 17 known from the state of the art in the region of the tooth root 15 can be eliminated. Instead of this the involute 25 follows upon the cycloid 33 as has already been described above. The transition between these two flank segments occurs smoothly, since the segments transit tangentially into one another at the point x3.

Preferably the radii of curvature of the cycloid 33 and the involute 25 are selected to be approximately equal in the region of the transition x3. Identical radii of curvature have been shown to be particularly expedient. Thereby the active tooth flank 21 is lengthened far into the region of the tooth root 15. This means the forces to be transmitted can in actual operation of this gearwheel mechanism be transmitted over a very large region of the tooth flank, so that very smooth running of the gearwheel mechanism results. At the same time it can be seen, that no kinks exist in the course of the flanks at the transition points x1, x2, and x3, so that a very uniform force transmission is also assured, resulting in very slight vibration excitation. This assists in assuring an operation generating very little noise.

The radius of the circle tangent to the tooth flank in the region x2 is chosen to be of such a magnitude, that the imagined center of this circle is located within the tooth. The circle which is tangent to the tooth flank in the region x3 has a larger radius selected in such a way, that the imagined center of this circle comes to lie outside of the tooth. Finally it has to be stated, that the radius of the circle tangent to the transition region 23 is smaller than the two above-mentioned radii.

The shape of the cycloid 33 is selected in such a way after all this, that upon entry of a new tooth an engagement shock with the edge 31 is avoided, while on the other hand however very early force transmission is possible.

It is easily seen overall, that the shape of the tooth in the top tooth tip region 25, 27, 29 is dependent upon the tooth shape in the bottom tooth region 25, 33, 23 and in reverse. In this way a rolling contact without engagement interferences results.

It is evident from the above that the tooth profile is composed of several different curve segments which are selected in such a way, that a straight line of action is formed at the pitch point in the region of the involute, which, referred to the pitch point, transits into a curved line of action in the region of the cycloids.

Figure 3:
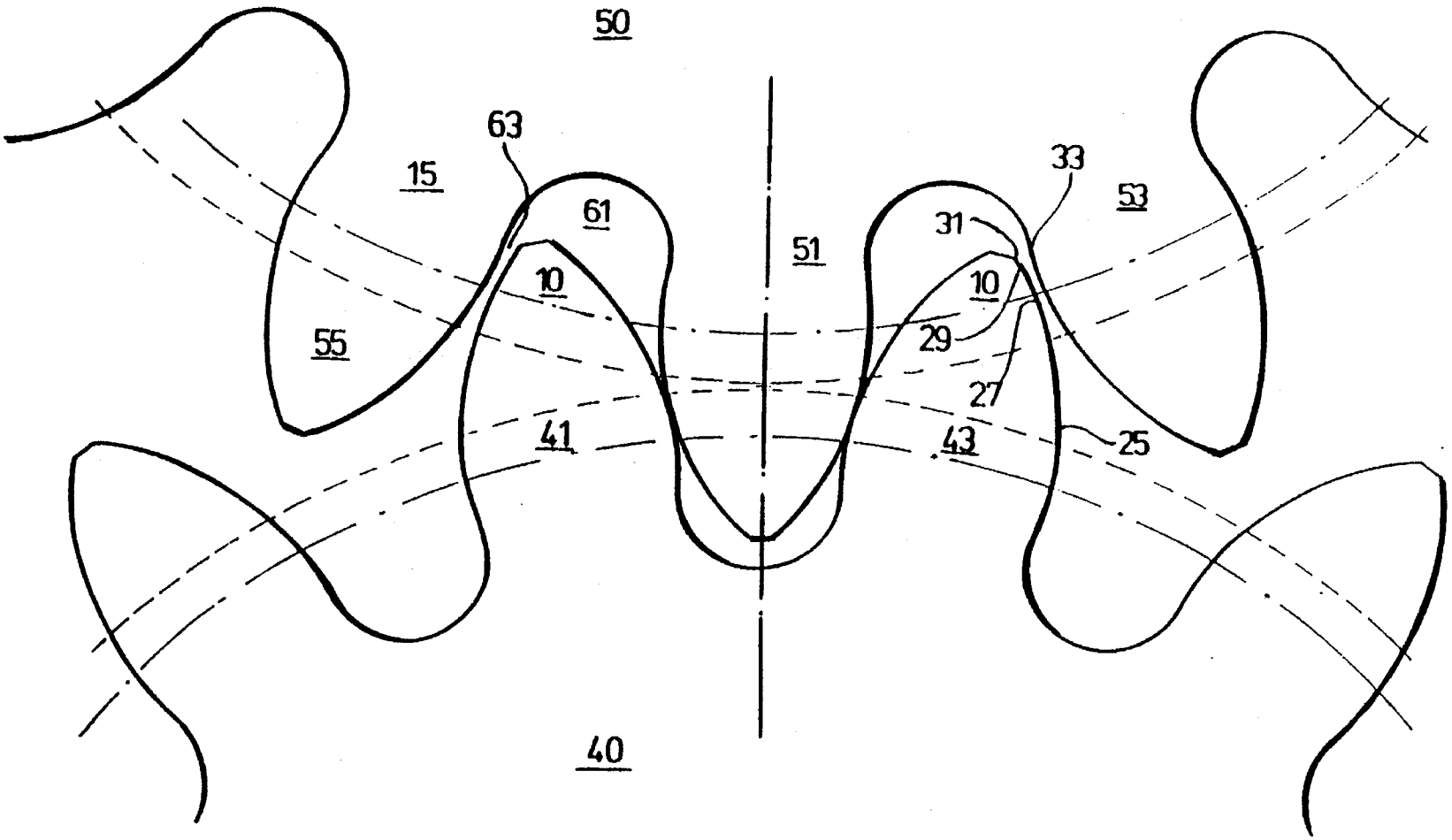
FIG. 3 a cutout of two gear wheels of a gearwheel mechanism with external set of teeth meshing with each other.

FIG. 3 shows two gear wheels 40 and 50 of a gearwheel mechanism. An external set of teeth is shown here by way of an example. The same reference numbers as those used in FIGS. 1 and 2 are also used in FIG. 3. To that extent it is not necessary to describe the associated parts in this case. While FIGS. 1 and 2 show teeth which have the invented flank on the one side and the known conventional flank on the other side, all the teeth of both gear wheels 40 and 50 in FIG. 3 are equipped with the invented flank on both sides.

A tooth 51 is in engagement between two teeth 41 and 43 in FIG. 3. Due to the circumstance that in the region of the tooth tip 10 of the tooth 43 the involute of the central tooth flank 25 is continued by a curved arc 27 or by a straight line segment 29, the edge 31 of the tooth 43 is displaced to such an extent backwards, that an engagement shock is avoided with certainty in the region of the tooth root 15 of the tooth 53 adjacent to the tooth 51. Herein we are dispensing with an undercut as it is for instance shown in FIG. 1 in the region of the tooth root of tooth 53. Rather the central flank region or its involute 25 is continued by a cycloid 23 at which the active flank 25 of the tooth 43 is almost still resting.

Gear wheel 50 has an additional tooth 55 on the left from tooth 51, which almost contacts tooth 41 of gear wheel 40. In the course of a clockwise revolution of the gear wheel 48 one has to proceed from the circumstance that, if the geared mechanism is used as a gear pump, a fluid enclosed in the intermediate space 61 between the teeth is increasingly subjected to higher pressures and escapes at high pressure through the gap 63 remaining between the tip 10 of tooth 41 and the root 15 of tooth 55. Fluid or oil subjected to high pressure has been shown to have an extraordinarily high load carrying capacity. Friction between the tooth 41 and the tooth 55 is thereby reduced to a minimum.

For the rest of it we proceed from the fact that the function of a gear pump is known so that it is not discussed here.

It is seen especially from the coaction of teeth 41 and 55 in FIG. 3 that as it were an entry skid is created by the design of the tooth flanks in the invention, which skid favors the buildup of an optimum lubrication film. At the same time a force transmittal occurring across a wide region is made possible by the extension of the active edge in the root region due to the cycloid provided there. A contact ratio factor up to the vicinity of 2 is obtained here.

Entry pitting and the so-called entry scoring is greatly reduced due to the avoidance of entry shock and by the lubrication film having an extremely high load carrying capacity, whereby the wear in the described gearwheel mechanism is reduced to a considerable extent.

At the same time it becomes clear that the noise reduction is optimum, since the tip engagement shocks are largely avoided. An additional noise reduction is obtained due to the circumstance, that because of the lubricating film structure the lubrication is not pierced during the convergence of the teeth 41 and 55 and also in the ensuing rolling of the involutes of the teeth 41 and 55 upon one another.

Figure 4:
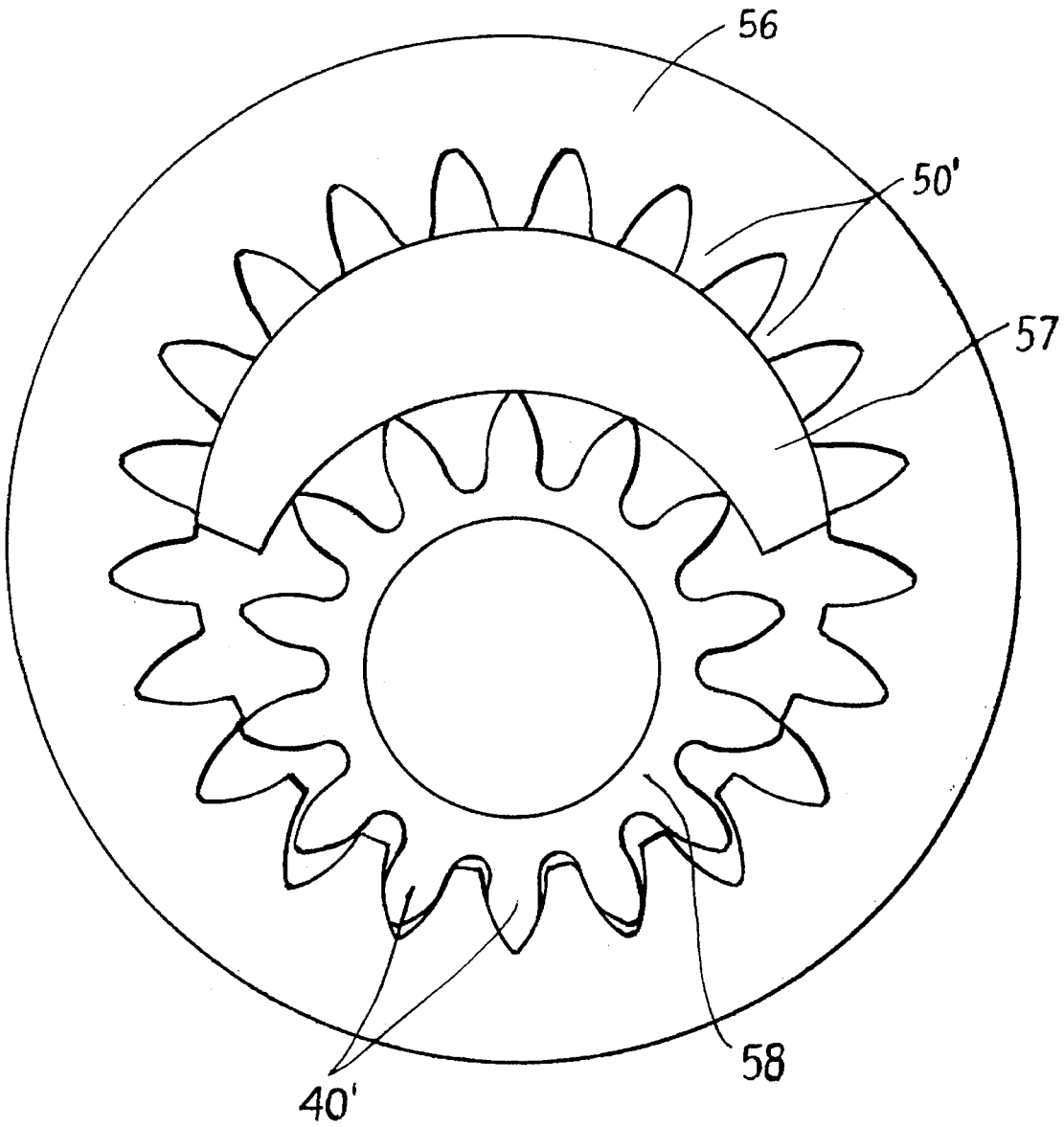
FIG. 4 is a gear mechanism with a set of internal and external teeth meshing with each other.

For the rest of it, it is clear that it is indeed possible to avoid on the one hand, that the edge 31 impinges upon the cycloid 33 of an adjacent tooth, that however this edge 31 can be used as a cutting edge, so that while maintaining the advantages of a cycloid-involute toothing, a very good radial entry is assured. The edge 31 can serve as a cutting edge in a gearwheel mechanism with external set of teeth and can remove material from the machine or mechanism or pump housing. In case of a gearwheel mechanism with an internal set of teeth which is shown in FIG.4 , this edge 31 can act upon a filler 57, which is located between a ring gear 56 with inner teeth 50' and a gearwheel 58 with outer teeth 40' and which is common in pumps with internal teeth, and can achieve there a good radial entry.

I claim:

1. An involute gearset, comprising at least two gear wheels having meshing teeth, wherein each tooth of each gear wheel has an end face and a flank formed of different profile shapes, said different profile shapes including an involute provided in a flank central region, an arcuate region adjoining the involute, and a straight line segment intersecting the end face, the arcuate region passing tangentially into the straight line segment, whereby a straight line of action is formed at a pitch point in a region of the involute.

2. An involute gearset according to claim 1, wherein the arcuate region comprises a circular arc.

3. An involute gearset according to claim 1, wherein radii of the involute and the arcuate region are substantially identical, and wherein the involute and the arcuate region pass into one another in a tangential manner.

4. An involute gearset according to claim 1, wherein a spacing of a first imaginary straight line, which extends parallel to the end face and intersects a transition between the involute and the arcuate region, from the end face is about twice as large as a spacing of a second imaginary line, which likewise extends parallel to the end face but interests a transition between the arcuate region and a straight line segment, from the end face.

5. An involute gearset according to claim 4, wherein the ratio of the spacing of the second imaginary line from the end face to a spacing between the first and second imaginary lines lies in a range of 40:60 to 60:40.

6. An involute gearset according to claim 5, wherein the range is 55:45 to 45:55.

7. An involute gearset according to claim 5, wherein the ratio is 50:50.

8. An involute gearset according to claim 1, wherein each tooth has a root region, and wherein tooth flanks of each tooth include a cycloid-like curve in the root region.

9. An involute gearset according to claim 8, wherein the cycloid-like curve comprises a cycloid.

10. An involute gearset according to claim 9, wherein the cycloid has a radius of curvature approximately equal to a radius of the involute in an immediately adjacent region of the involute.

11. An involute gearset according to claim 10, wherein the cycloid and the immediately adjacent region of the involute have identical radii.

12. An involute gearset according to claim 9, wherein the cycloid passes tangentially into a curve leading into a tooth root area of an adjacent tooth.

13. An involute gearset according to claim 9, wherein a shape of an upper region of each tooth depends on a shape of a lower region of the tooth.

14. An involute gearset according to claim 1, wherein one of the at least two gear wheels has inner teeth and another of the at least two gear wheels has outer teeth.

* * * * *